United States Patent [19]

Riley

[11] Patent Number: 4,735,119

[45] Date of Patent: Apr. 5, 1988

[54] MANUALLY OPERATED GEAR WRENCH

[76] Inventor: Alfred B. Riley, 4304 Clearbrook La., Kensington, Md. 20814

[21] Appl. No.: 19,111

[22] Filed: Feb. 26, 1987

[51] Int. Cl.[4] ..... B25B 17/00; B25B 13/46

[52] U.S. Cl. ..... 81/57.3; 81/58.1; 81/61; 74/421 R

[58] Field of Search ..... 81/58, 58.1, 60, 61, 81/57.3, 57.22, 57.24, 57.14, 57.31; 74/421 R, 413, 530

[56] References Cited

U.S. PATENT DOCUMENTS

| | | | |
|---|---|---|---|
| 732,108 | 6/1903 | Osborne | 81/57.3 |
| 1,648,134 | 11/1927 | Kientz | 81/57.3 |
| 2,520,443 | 8/1950 | Seaquist | 81/58.1 |
| 2,756,792 | 7/1956 | Hirschman | 81/57.3 X |
| 3,979,965 | 9/1976 | Vuceta | 81/57.3 X |
| 4,535,653 | 8/1985 | Coburn | 81/57.31 X |

FOREIGN PATENT DOCUMENTS

| | | | |
|---|---|---|---|
| 2394368 | 2/1979 | France | 81/57.3 |
| 2445758 | 9/1980 | France | 81/57.24 |

*Primary Examiner*—Debra Meislin

*Attorney, Agent, or Firm*—Brady, O'Boyle & Gates

[57] ABSTRACT

A manually operated gear wrench having a fixed hand plate and a wrench plate rotatably mounted thereon. The wrench plate carries a ring gear which meshes with a pinion gear rotatably mounted on the hand plate. Studs adapted to selectively receive socketed handles and tools are connected to the pinion gear and wrench plate. By connecting an operating handle to the pinion stud and a tool to the wrench plate stud, an input to output ratio of 3:1 is obtained. By connecting the operating handle to the wrench plate stud and the socketed tool to the pinion stud, an input to output ratio of 1:3 is obtained. A releasable locking mechanism is provided between the hand plate and pinion gear to prevent relative rotation between the pinion gear and ring gear to thereby provide an input to output ratio of 1:1.

12 Claims, 2 Drawing Sheets

FIG. 2
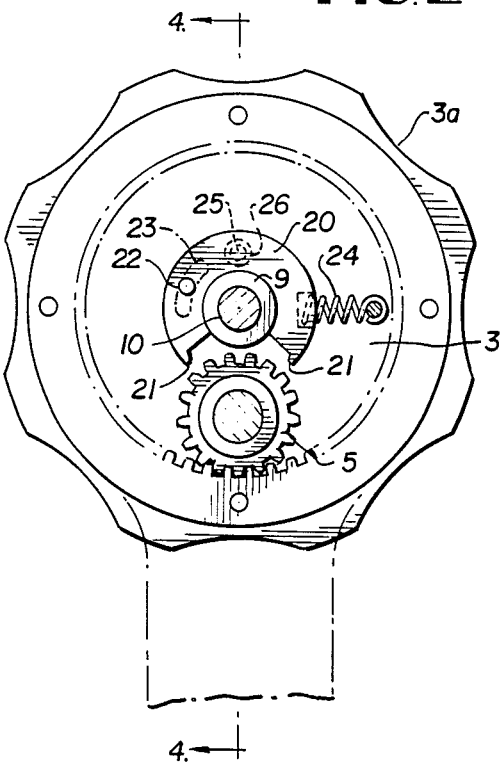
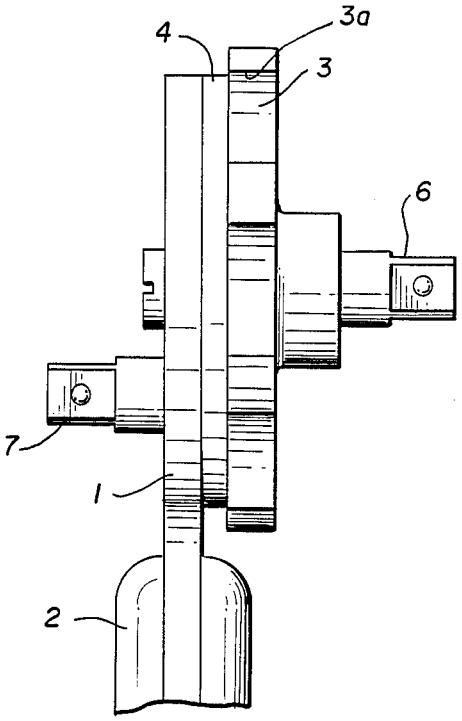
FIG. 3
FIG. 4
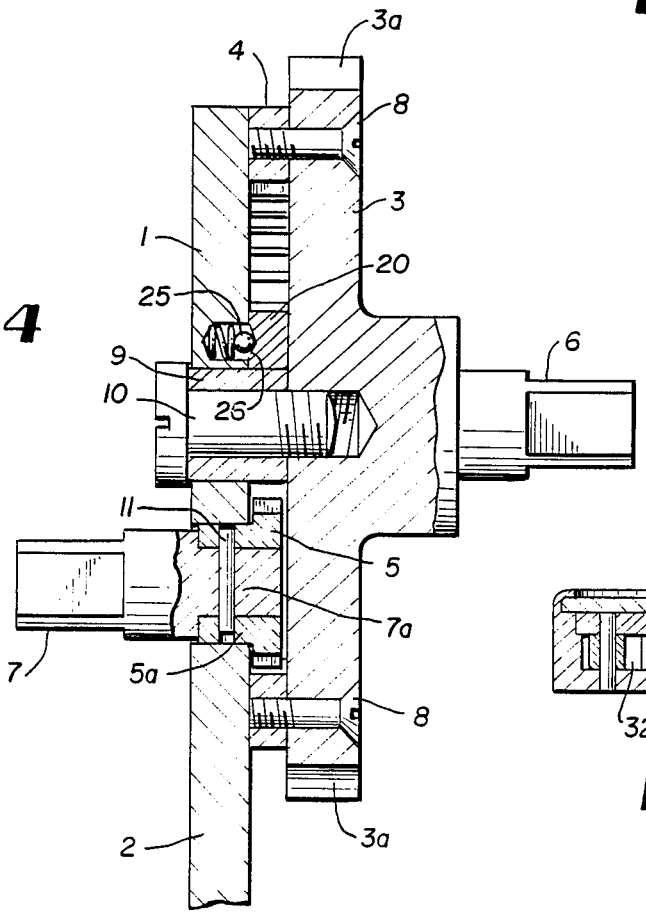
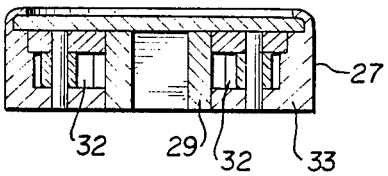
FIG. 6

MANUALLY OPERATED GEAR WRENCH

BACKGROUND OF THE INVENTION

The broad concept of gear wrenches, that is, wrenches including a ring gear meshing with a pinion gear to drive a tool such as a screw driver or drill, is known. Such wrenches are disclosed, for example, in U.S. Pat. Nos. 732,108 and 2,756,792. These wrenches are designed to produce a desired input to output ratio; that is, rotation of the operating handle results in desired rotation of the tool. In using the tool for some applications, it is desirable to have a relatively fast output; therefore, the wrench is designed to have, for instance, a 1:3 ratio. In other applications, it is desirable to have a relatively slow output; therefore, the tool is designed to have, for instance, a 3:1 ratio.

Heretofore, it was necessary for the worker or operator to carry a plurality of gear wrenches, each having the desired input-output ratio. After considerable research and experimentation, the gear wrench of the present invention has been devised to provide multiple input ratios such as 1:3, 3:1 and 1:1, whereby the worker is only required to carry one gear wrench for multiple applications.

The manually operated gear wrench of the present invention comprises, essentially, a fixed hand plate and a wrench plate rotatably mounted thereon. The wrench plate carries a ring gear which meshes with a pinion gear rotatably mounted on the hand plate. Studs adapted to selectively receive socket handles and tools are connected to the pinion gear and wrench plate. By connecting an operating handle to the pinion stud and a tool to the wrench plate stud an input to output ratio of approximately 3:1 is obtained. By connecting the operating handle to the wrench plate stud and the socketed tool to the pinion stud an input to output ratio of approximately 1:3 is obtained. A releasable locking mechanism is provided between the fixed hand plate and pinion gear to prevent relative rotation therebetween, to thereby provide an input to output ratio of 1:1. Further, the locking mechanism, when placed in a neutral disengaged position, allows a 1:1 ratio to result when the user grasps a hand grip portion on the wrench plate.

The operating handle can be either a crank or a hand knob containing a ratchet mechanism. It is contemplated that various tools, such as drills, screw drivers, socket wrenches, Allen wrenches, and the like, can be employed.

BRIEF DESCRIPTION OF THE DRAWINGS

FIG. 2 is a view taken along line 2—2 of FIG. 1;

FIG. 3 is a fragmentary side elevational view of the gear wrench;

FIG. 4 is a view taken along line 4—4 of FIG. 2:

FIG. 6 is a view taken along line 6—6 of FIG. 5 with the cover plate in place.

DESCRIPTION OF THE PREFERRED EMBODIMENT

Figures 1, 5:
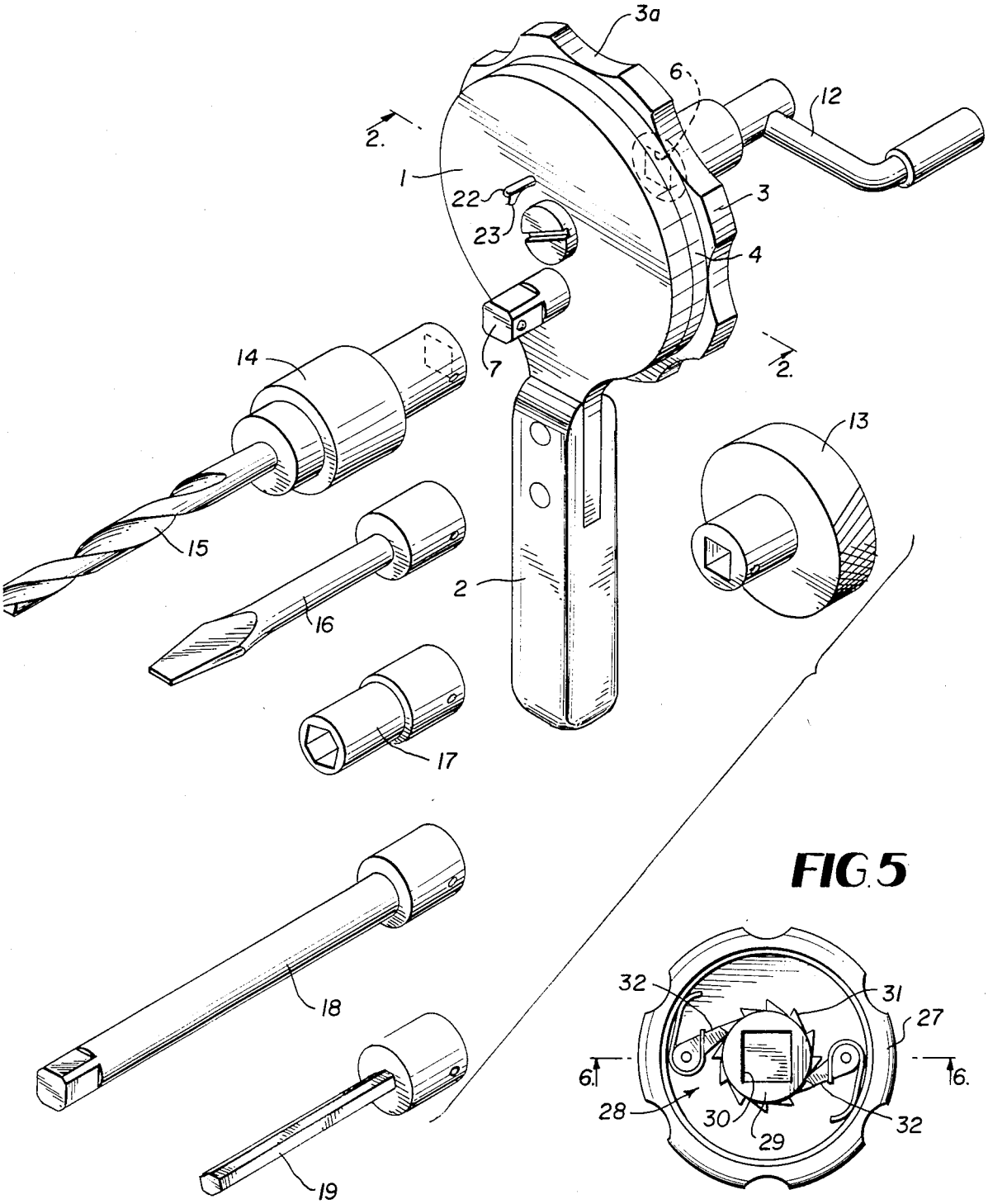
FIG. 1 is a perspective view of the gear wrench of the present invention illustrating the various tools adapted to be employed and the crank and hand knob operating handles.
FIG. 5 is a top plan view of a hand knob with the cover plate removed to show the ratcheting mechanism within the knob.

Referring to the drawings and more particularly to FIGS. 1, 3 and 4, the gear wrench of the present invention comprises, a fixed hand plate 1 having a handle 2 connected thereto. A wrench plate 3, having a manual hand grip portion 3*a* on the peripheral edge thereof, is rotatably mounted on the hand plate 1 and an internal ring gear 4 is secured to the wrench plate 3, the ring gear meshing with a pinion gear 5 rotatably mounted in the hand plate 1.

A conventional socket receiving stud 6 is fixedly connected to the central portion of the wrench plate 3 and a similar stud 7 is connected to the pinion gear 5, the studs being adapted to selectively receive a socketed operating handle and a socketed tool, to be described more fully hereinafter.

The details of the structural arrangement of the hand plate 1, wrench plate 3, ring gear 4 and pinion 5 are shown in FIG. 4 wherein it will be seen that the ring gear 4 is fastened to the wrench plate by a plurality of machine screws 8. The wrench plate 3 and associated ring gear 4 are rotatably mounted on the hand plate 1 through a bushing 9 mounted on a bolt 10 extending through the hand plate 1 and threaded into the wrench plate 3. The stud 7 is connected to the pinion gear 5 by a transverse pin 11 extending through the pinion gear hub portion 5*a* and stud shaft portion 7*a*.

Referring to FIG. 1, the studs 6 and 7 are adapted to receive a socketed operating handle in the form of a crank 12 or hand knob 13, and a socketed tool which can include, for example, a socketed chuck 14 carrying a drill 15, a socketed screw driver 16, socket wrench 17, or Allen wrenches 18, 19.

In the operation of the wrench thus far described, it will be apparent by those skilled in the art that by connecting an operating handle to the stud 6 and a selected tool to the stud 7, rotation of the wrench plate 3 by the operating handle will cause rotation of the pinion gear 5 and associated tool mounted on the stud 7. Because of the relative diameters of the input gear 4 and output gear 5, the stud 7 will be driven at a faster speed than the stud 6. By way of example, the ratio of input to output could be approximately 1:3. If a slower output is desired, the operating handle would be connected to stud 7 and the selected tool would be connected to stud 6; therefore, considering stud 7 as the input and stud 6 as the output, rotation of stud 7 will cause rotation of stud 6 at an approximate 3:1 ratio.

In some use of the wrench of the present invention, a 1:1 ratio might be required. For this purpose, a releasable locking mechanism is provided between the hand plate 1 and pinion gear 5. As will be seen in FIGS. 2 and 4, the locking mechanism comprises a sector plate 20 journaled on the bushing 9. The sector plate is provided with abutments 21 adapted to engage the teeth on the pinion gear 5. A pin 22 is secured to the plate 20 and extends through an arcuate slot 23 provided in the hand plate 1. By grasping the pin 22, the sector plate 20 can be rotated to cause a selected abutment 21 to engage a tooth on the pinion gear 5, to thereby prevent relative rotation of the ring and pinion gears. To hold the sector plate 20 in the locked position, an over-center toggle spring 24 is provided between the sector plate 20 and the hand plate 1. To hold the sector plate 20 in the released or neutral position, as shown in FIG. 2, a spring biased ball detent 25 is mounted between the hand plate 1 and a recess 26 formed in the face of the sector plate 20.

In using the gear wrench during the 1:1 mode of operation, the user would attach the desired tool to either studs 6 or 7 and grasp the handle 2 to turn the wrench. An additional 1:1 use feature could be obtained by placing a tool on stud 6 and manually rotating the wrench plate 3 while gripping the peripheral edge 3*a*.

Referring to FIGS. 5 and 6, a hand knob housing 27 having a ratcheting mechanism 28 contained therein is shown for use on the gear wrench as an operating handle. The ratcheted hand knob comprises a cylindrical hub portion 29 having a rectangular bore 30 corresponding to the cross-sectional configuration of studs 6 and 7 for reception thereon. The outer peripheral surface of the hub portion 29 is provided with a plurality of teeth 31 adapted to be engaged by spring biased pawls 32 pivotally mounted on the bottom wall 33 of the hand knob housing. The hand knob housing 27 is rotatably mounted on the hub portion 29 so that when the knob is turned clockwise, as viewed in FIG. 5, the knob housing 27 will rotate relative to the hub portion 29. When the knob is turned counter-clockwise, as viewed in FIG. 5, the pawls 32 engage the teeth 31 to provide a drive connection through the hub to the attached stud.

From the above description, it will be readily apparent by those skilled in the art that the construction and arrangement of the gear wrench provides in one tool the multiple input-output ratios which heretofore were only obtainable in multiple tools, and while the ratios of 1:3 and 3:1 were used in the description of the gear wrench of the present invention, other ratios can be employed depending upon the relative sizes selected for the internal ring gear 4 and pinion gear 5.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A manually operated gear wrench comprising, a fixed hand plate, a wrench plate, shaft means extending between said hand plate and wrench plate for rotatably mounting said wrench plate on said hand plate in face-to-face relationship, an internal ring gear mounted on said wrench plate, a pinion gear rotatably mounted on said hand plate, said pinion gear meshing with said ring gear, a stud connected to said wrench plate, a stud connected to said pinion gear, an operating handle removably connected to one of said studs, and tool means removably connected to the other of said studs, whereby when the operating handle is connected to the wrench plate stud as the input and the tool means is connected to the pinion stud as the output, a relatively fast input to output ratio is obtained, and when the operating handle is connected to the pinion stud as the input and the tool means is connected to the wrench plate stud as the output, a relatively slow input to output ratio is obtained, and a releasable locking mechanism between the hand plate and pinion gear to prevent relative rotation therebetween, to thereby provide an input to output ratio of 1:1, said locking mechanism comprising a sector plate mounted on said shaft means, at least one abutment on said sector plate adapted to engage the teeth on the pinion gear, a pin connected to each sector plate and extending through a slot provided in said hand plate, whereby the sector plate can be manually pivoted about said shaft means to engage or disengage the abutment with the pinion gear means, and over-center toggle spring means mounted between the sector plate and hand plate for holding the sector plate in the engaged position.

2. A manually operated gear wrench according to claim 1, wherein a pair of abutments are provided on the sector plate.

3. A manually operated gear wrench according to claim 2, wherein spring-biased detent means are mounted between the sector plate periphery and the hand plate for holding the sector plate in the released position.

4. A manually operated gear wrench according to claim 1, wherein the studs are rectangular in cross-sectional configuration and the operating handle and tool means are provided with similarly configured socket portions adapted to be received by the studs.

5. A manually operated gear wrench according to claim 4, wherein the operating handle comprises a crank.

6. A manually operated gear wrench according to claim 4, wherein the operating handle comprises a hand knob.

7. A manually operated gear wrench according to claim 6, wherein the hand knob includes a ratcheting mechanism.

8. A manually operated gear wrench according to claim 4, wherein the tool means comprises a drill.

9. A manually operated gear wrench according to claim 4, wherein the tool means comprises a screw driver.

10. A manually operated gear wrench according to claim 4, wherein the tool means comprises a socket wrench.

11. A manually operated gear wrench according to claim 4, wherein the tool means comprises an Allen wrench.

12. A manually operated gear wrench according to claim 1, wherein a handle is fixedly connected to said hand plate.

* * * * *